US007165971B2

(12) United States Patent
Emricson

(10) Patent No.: US 7,165,971 B2
(45) Date of Patent: Jan. 23, 2007

(54) ASSOCIATION METHOD AND ASSOCIATION DEVICE FOR A COMBAT EXERCISE

(75) Inventor: Ingemar Emricson, Bankeryd (SE)

(73) Assignee: Saab AB, Linkoping (SE)

( * ) Notice: Subject to any disclaimer, the term of this patent is extended or adjusted under 35 U.S.C. 154(b) by 414 days.

(21) Appl. No.: 10/481,585

(22) PCT Filed: Jun. 6, 2002

(86) PCT No.: PCT/SE02/01091

§ 371 (c)(1),
(2), (4) Date: Dec. 22, 2003

(87) PCT Pub. No.: WO03/001139

PCT Pub. Date: Jan. 3, 2003

(65) Prior Publication Data

US 2004/0146839 A1 Jul. 29, 2004

(30) Foreign Application Priority Data

Jun. 25, 2001 (SE) ..... 0102297

(51) Int. Cl.
*G09B 19/00* (2006.01)

(52) U.S. Cl. ..... 434/11; 434/16; 463/5

(58) Field of Classification Search ..... 434/11, 434/16, 17, 19.21, 27, 365; 42/70.11, 84, 42/116; 340/5.6; 463/5; 700/91
See application file for complete search history.

(56) References Cited

U.S. PATENT DOCUMENTS 5,303,495 A * 4/1994 Harthcock ..... 42/84
5,320,362 A * 6/1994 Bear et al. ..... 463/5
5,359,510 A * 10/1994 Sabaliauskas ..... 700/91
5,448,847 A * 9/1995 Teetzel ..... 42/70.11
5,461,812 A 10/1995 Bennett
5,502,915 A * 4/1996 Mendelsohn et al. ..... 42/70.11
5,842,300 A * 12/1998 Cheshelski et al. ..... 42/116
6,129,549 A * 10/2000 Thompson ..... 434/16
6,254,394 B1 * 7/2001 Draper et al. ..... 434/11
6,406,298 B1 * 6/2002 Varshneya et al. ..... 434/21
6,450,817 B1 * 9/2002 Deinlein ..... 434/11
6,856,238 B1 * 2/2005 Wootton et al. ..... 340/5.61

FOREIGN PATENT DOCUMENTS

DE 3443779 C1 5/1991
EP 0222110 A2 5/1987
EP 0281135 A1 9/1988

* cited by examiner

*Primary Examiner*—Joe H. Cheng
(74) *Attorney, Agent, or Firm*—Bingham McCutchen LLP

(57) ABSTRACT

The invention concerns a method for associating an object of a second type with at least one object from a group of objects of a first type. The method is to be used in combat exercises and the above mentioned objects are players and weapons. According to the method, a signal containing the identity of the object is transmitted from each object in the group, whereupon the transmitted signals are received by the object of the second type, and the received signals are analyzed. The object of the second type is then associated with at least one preferred object in the group on the basis of the signal analysis, whereupon any previous association(s) of the object of the second type with objects of the first type is/are taken into account in the associating process. The invention also includes a device for a receiver arranged so as to realize the foregoing method.

12 Claims, 2 Drawing Sheets

ASSOCIATION METHOD AND ASSOCIATION DEVICE FOR A COMBAT EXERCISE

TECHNICAL AREA

The invention concerns an association method for associating an object of a second type with at least one object in a group of objects of a first type in combat exercises.

The invention also concerns a device for receivers for associating an object of a second type with at least one object in a group of objects of a first type in combat exercises.

STATE OF THE ART

During combat exercises, infantry players carry weapons that must be prevented from firing if the player is eliminated. "Firing" refers not only to the firing of live or blank rounds, but also to the firing of simulated rounds in the form of, e.g. laser beams, from a weapon-mounted firing simulator. To make the exercise situation even more realistic, it is also desirable for the players to be able to exchange weapons with one another, whereupon each weapon will automatically be associated with the new player to whom it belongs.

A currently known solution to this problem is based on the use of a unidirectional radio link from each player to his associated weapon/weapon simulator. In a very simple variant, the sole criterion applied is that the transmissions of the player that are received with the greatest frequency serve as a means of determining the player to whom the weapon/weapon simulator belongs. In a refined variant, signal-strength measurements are also used.

The radio receiver of the weapon/weapon simulator then also determines the associated player based on the criterion of which player is being received the strongest, and is thus closest and should consequently be the player in possession of the weapon.

However, the field intensity of the radio beam at a given distance from the transmitting player is not homogenous in practice, due to reflections, interference, etc. This phenomenon creates problems particularly when the infantry players are very close to one another and not in motion, e.g. in a trench, and in such situations there is a risk that the weapon/weapon simulator will be associated with the wrong player object.

DESCRIPTION OF THE INVENTION

One object of the invention is to eliminate or at least reduce the problem of associations with incorrect objects in certain situations. This has been achieved in one embodiment using a method in which one object of a second type is associated with at least one object from a group of objects of a first type. The method involves the transmission by each object of the first type of a signal that contains the identity of that object. The signal is, for example, a radio signal, ultrasonic signal or IR light. The signals transmitted by the object of the first type are received by the object of the second type. The received signals are analyzed, whereupon the object of the second type is associated, based on the signal analysis, with a preferred object of the first type. The method is characterized in that any previous association(s) of the object of the second type with the object of the first type is/are taken into account in the associating process.

In a preferred embodiment, the object of the first type is a player object, while the object of the second type is a weapon object. The word "weapon" is applied herein in the broadest sense and, in additional to including weapons for firing live ammunition, also includes firing simulators for firing simulated ammunition in the form of, e.g. laser beams. Such firing simulators may be mounted on the weapon.

In an alternative variant in which it is the players who receive a signal transmitted by the weapon, the object of the first type is the weapon object, while the object of the second type is a player object.

Additional preferred embodiments may exhibit one or more of the characteristic features such as: in connection with the signal analysis, there is generated for each object of the first type a quality factor that includes a measure of the received signal quality from said object plus, at least for the object of the first type most recently associated with the second object, a bonus value belonging to said object, whereupon the object of the first type with the most advantageous quality factor is associated with the object of the second type: the received signal strength is measured for each object of the first type, whereupon the measured signal strength is included in the signal quality measurement: a measurement of the reception interval is determined for each object of the first type, whereupon the reception interval is included in the signal quality measurement:

in connection with the association of a new object of the first type with the object of the second type, the bonus value of the new object is increased as a function of time until a maximum value is reached: and in connection with the association of the new object with the object of the second type, the bonus value of the object previously associated with the object of the second type is decreased as a function of time until a minimum value is reached.

In practice, weapons are exchanged fairly infrequently during an exercise. When such an exchange does occur, there is reason to assume that the player who is abandoning his weapon will not remaining standing/lying next to it unless he has been rendered incapable of firing it (e.g. eliminated). In the association principle according to the invention, certain objects are favored through the incorporation of a bonus value. The bonus value thus indicates the extent to which each respective object will be favored. During signal analysis, such favoritism is weighed along with other association criteria such as signal strength, reception interval, etc. with reference to earlier associations.

According to one embodiment, the bonus value is varied along on a time axis. The object with which the weapon/player is associated is given an increasing bonus value up until a ceiling is reached. The bonus values of other objects are decreased as a function of time until they reach a minimum value, e.g. 0. An object with which the weapon/player is associated for an extended period of time will thus be favored over others. Each time a signal analysis is performed to determine association with one of the objects, the bonus value is weighed together with other association criteria for the object with which previous association(s) occurred to generate a quality factor. The bonus values for other objects are not weighed in when generating the quality factor.

A substantial improvement in the reliability achieved in the object association process is attained when a bonus value is linked to each object and the correct value choices are made in terms of the rate of increase, rate of decrease and maximum value. It is also possible to establish adequate associations even in situations where it would not otherwise be possible to do so by means of radio links.

The principle of also allowing a selected object that is not currently considered to belong to the weapon/player to retain its cumulative bonus value for a period of time also creates the possibility of group favoritism. In a situation in which two player objects share a single weapon, both players will be accorded 50% of the full bonus/favoritism relative to other player objects.

It is obviously not necessary for association to occur between only one player, in the form of a soldier, and one weapon. An exercise situation is alternatively conceivable in which each transmitter is arranged on a vehicle or fixed object in the form of a building or the like, while each receiver is arranged on a player such as a solider. In this embodiment the player can be associated with a vehicle or building to which he belongs.

The invention also concerns a device for receivers arranged so as to receive transmitted signals from a group of objects, wherein each signal contains a unique identity for an appurtenant object with which the receiver can be associated, and wherein there are processing means connected to the receiver and arranged so as to analyze and process the received signals in order to establish an association with at least one preferred object, wherein the processing means are arranged so as to take any previous association(s) with the object into account in the association process.

Preferred embodiments may exhibit one or more of the characteristics such as the processing means are arranged so as to generate for each object a quality factor containing a measurement of the received signal quality from said object plus, at least for the object of the first type most recently associated with the receiver, a bonus value belonging to said object, and associate the object having the most advantageous quality factor with the receiver; the processing means are arranged so as to base the signal Quality measurement on the received signal strength and/or reception interval; the processing means are arranged so as, in connection with the association of a new object with the receiver, to modify the bonus value of the object so that said value increases as a function of time until a maximum value is reached; the processing means are arranged so as, in connection with the association of the new object with the receiver, to modify the bonus value of the object previously associated with the receiver so that said value decreases as a function of time until a minimum value is reached; and the processing means are connected to a read/write memory arranged so as to store at least the identities of the objects in the group and the bonus value appurtenant to each identity.

BRIEF DESCRIPTION OF THE FIGURES

The invention will be described in detail below with the help of exemplary embodiments, and with reference to the accompanying drawing. In the drawing.

PREFERRED EMBODIMENTS

Figure 1:
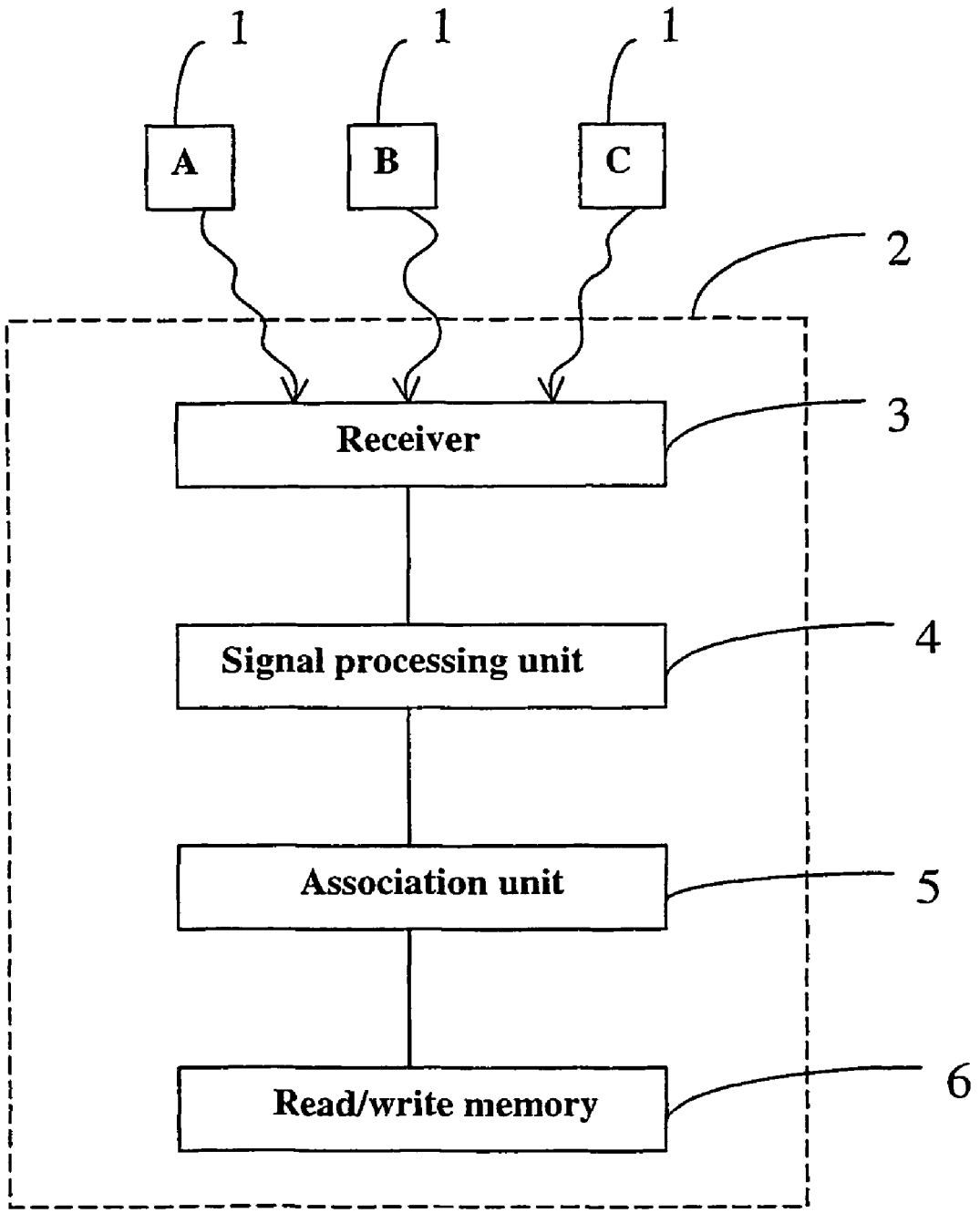
FIG. 1 shows a system for associating a weapon with a player.

In FIG. 1, reference number 1 designates a number of identical transmitters A, B and C. In the example described here, each of these transmitters is carried by a player, e.g. an infantryman who is taking part in a military exercise. The transmitters are carried by the players in that they are, e.g. installed in vests worn by the players. Each transmitter transmits a signal in the form of, e.g. a radio signal, ultrasonic signal or IR light. The signal from each transmitter is pulsed and transmitted at a pulse frequency that is the same for all the transmitters. The signals contain information about the unique identity of their transmitter and have a predetermined transmission strength that is the same for all the transmitters A, B and C.

Weapons or weapon simulators used in the military exercise are equipped with a receiving and evaluating unit 2 to receive and evaluate the signals transmitted from the transmitters 1. A conventional receiver 3 encompassed in the unit 2 receives the incoming signals and converts then into electrical signals to be processed in a signal-processing unit 4. The signal-processing unit 4 extracts the identify of the transmitter from each received signal, measures the received signal strength and generates a measure of the reception rate. The measure of the reception rate is defined here as a measure of how frequently an error-free message is received from one of the transmitters A, B or C. The signal-processing unit 4 can comprise hardware circuits and/or be made up of software modules designed to extract the transmitter identities and determine the signal strengths and reception rates. The design of such hardware circuits/software modules will be a routine matter for one skilled in the art, and consequently no detailed description thereof is provided here. The signal-processing unit 4 continuously measures data concerning the measured signal strength and reception rate for each transmitter identity. These data are received by an association unit 5 that generates, for each of the transmitter identities, a quality factor for the received signal. This quality factor includes a weighted total of the signal strength measurement and the reception rate. In a simple embodiment neither the signal strength measurement nor the reception rate are included in the quality factor. The associating unit also generates for each identity a bonus value that is updated for each update of the quality factor. The bonus value is structured so that when a new identity is associated with the weapon/simulator, the bonus value of the new identity is increased as a function of time until a maximum value is reached. Upon association of the new identity with the weapon/simulator, the bonus value of the identity previously associated with the weapon/simulator decreases as a function of time until said bonus value reaches zero. In calculating the quality factors for the identities, the bonus value is included in the quality factor for the identity that is associated with the weapon/simulator, while the bonus values for other identities are not included in the calculation of the quality factor. If the identity previously associated with the weapon/simulator again acquires the highest quality factor, said identity will resume its association with the weapon/simulator, whereupon the bonus value will again be built up from the value it had when the identity was re-associated with the weapon/simulator.

The quality factors with appurtenant bonus values are stored for each of the transmitter identities in a read/write memory 6 connected to the association unit 5. The association unit 5 continuously updates the quality factors in the memory as new data concerning signal quality are received from the signal-processing unit 4.

Figure 2:
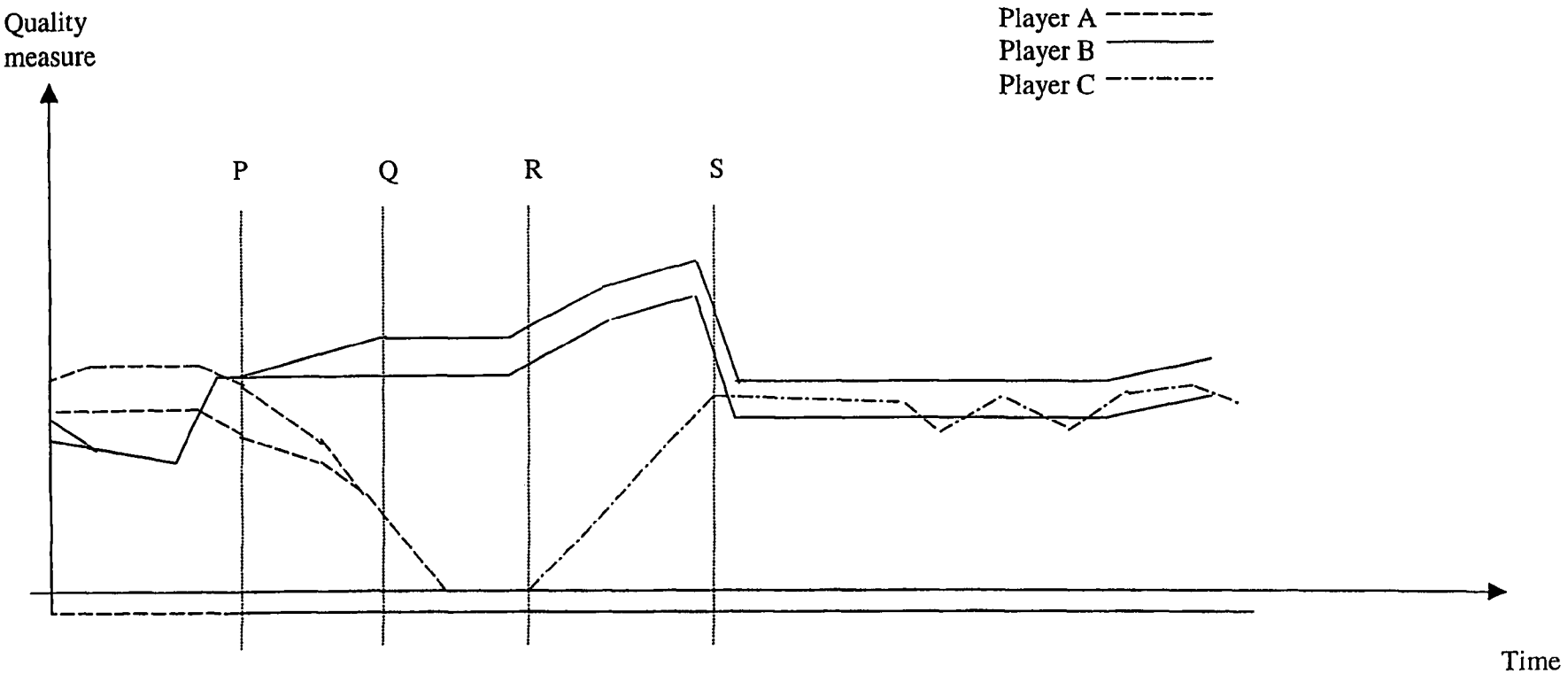
FIG. 2 shows an example of how quality factors for three players can vary in an exercise situation in accordance with the system in FIG. 1.

FIG. 2 illustrates how the weapon/simulator is associated with one of the transmitters A, B and C carried by an appurtenant player during use of the system described in FIG. 1. The curves comprise both an upper and a lower curve section, wherein the lower curve section represents the quality factor excluding the bonus value, while the upper curve section represents the quality factor including the bonus value. The identity of the transmitter associated with the weapon/simulator is indicated in the field below the time axis.

The lower curve for each player thus provides a measure of the basic quality of the signal, excluding bonuses. This quality value is the one that is compared to the signals from the other transmitters unless the transmitting unit is the possessor of the receiver, i.e. the transmitter with which the receiver is associated at the time. In that case the basic quality plus the bonus value (the upper curve) is instead compared to the lower curve for the other transmitter. The transmissions of the possessor thus accrue the bonus, if any, upon comparison, while all other transmissions are evaluated excluding this value.

In FIG. 2 the first transmitter A is associated with the weapon/simulator, and the quality factor of A, including the bonus value, is compared to the quality factors for B and C, excluding bonuses. At point P, A turns his weapon over to B and goes on his way. This degrades the signal quality, as is indicated in the lower section of the quality factor for A. The bonus value is simultaneously decreased gradually, as is illustrated in that the upper curve gradually approaches the lower curve, until it eventually coincides therewith. Because B is associated with the weapon, the bonus value for B builds up until its maximum value is reached at point Q. At point R, C begins to approach B, and the player who is carrying the transmitter C positions himself at the point S, next to the player who is carrying the transmitter B. In terms of time, C has a somewhat higher quality factor excluding the bonus value but, because the player possessing B has been the carrier of the weapon for an extended period, and thus accrues the resulting high bonus value, no re-association with C occurs.

The invention claimed is:

1. A method for associating combat exercise object of a second type with at least one combat exercise object of a plurality of combat exercise objects of a first type in combat exercises, the method comprising:

transmitting from each of the plurality of combat exercise objects of the first type a signal containing the identity of the combat exercise object;

receiving the signals transmitted from the plurality of combat exercise objects of the first type at the combat exercise object of the second type; and analyzing the received signals, whereupon the combat exercise object of the second type is associated with at least one preferred combat exercise object of the first type based on the signal analysis;

wherein any previous association of the combat exercise object of the second type with combat exercise objects of the first type is taken into account in the associating process; and wherein the signal analysis is performed by generating, for each combat exercise object of the first type, a quality factor that includes a measurement of a received signal quality from each combat exercise object, plus, at least for a combat exercise object of the first type most recently associated with the second combat exercise object, a bonus value belonging to the combat exercise object, and associating the combat exercise object of the first type with a most advantageous quality factor with the combat exercise object of the second type.

2. The method according to claim 1, wherein the combat exercise objects of the first type are player objects and the combat exercise object of the second type is a weapon object.

3. The method according to claim 1, wherein the combat exercise objects of the first type are weapon objects and the combat exercise object of the second type is a player object.

4. The method according to claim 1, further comprising measuring a received signal strength for each combat exercise object of the first type, and including the measured received signal strength in the received signal quality measurement.

5. The method according to claim 1, further comprising measuring a reception interval for each combat exercise object of the first type, and including the reception interval in the signal quality measurement.

6. The method according to claim 1, further comprising associating a new combat exercise object of the first type with the combat exercise object of the second type, including increasing the bonus value of the new combat exercise object as a function of time until a maximum value is reached.

7. The method according to claim 6, wherein associating the new combat exercise object with the combat exercise object of the second type, includes decreasing the bonus value of the combat exercise object previously associated with the combat exercise object of the second type as a function of time until a minimum value is reached.

8. A combat exercise device comprising:

a receiver operable to receive transmitted signals from a plurality of combat exercise objects of a first type, wherein each signal contains a unique identity for a combat exercise object of a first type with which the combat exercise device can be associated; and processing means connected to the receiver and operable to analyze and process the received signals in order to establish an association with at least one preferred combat exercise object of the first type with the combat exercise object of a second type, wherein the processing means is further operable to take any previous association with a combat exercise object of the second type with combat exercise objects of the first type into account in the associating process; to generate for each combat exercise object of the first type, a quality factor that includes a measurement of a received signal quality from each combat exercise object, plus, at least for a combat exercise object of the first type most recently associated with the second combat exercise object, a bonus value belonging to the combat exercise object, and to associate the combat exercise object of the first type with a most advantageous quality factor with the combat exercise object of the second type.

9. The device according to claim 8, wherein the processing means is further operable to base the signal quality measurement on the received signal strength, a reception interval, or both.

10. The device according to claim 8, wherein the processing means is further operable, in connection with an association of a new combat exercise object of the first type with the combat exercise object of the second type, to modify the bonus value of the new combat exercise object so that said value increases as a function of time until a maximum value is reached.

11. The device according to claim 10, wherein the processing means is further operable, in connection with an association of the new combat exercise object of the first type with the combat exercise object of the second type, to modify the bonus value of the combat exercise object previously associated with the combat exercise object of the second type so that said value decreases as a function of time until a minimum value is reached.

12. The device according to claim 8, wherein the processing means are connected to a read/write memory operable to store at least identities of the plurality of combat exercise objects and a bonus value associated with each identity.

* * * * *